US009371836B2

(12) United States Patent
Mornan et al.

(10) Patent No.: US 9,371,836 B2
(45) Date of Patent: Jun. 21, 2016

(54) MIXED FLOW FAN ASSEMBLY

(71) Applicants: Brian J. Mornan, Basking Ridge, NJ (US); Frank J. Beitz, Flemington, NJ (US)

(72) Inventors: Brian J. Mornan, Basking Ridge, NJ (US); Frank J. Beitz, Flemington, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 283 days.

(21) Appl. No.: 14/062,311

(22) Filed: Oct. 24, 2013

(65) Prior Publication Data

US 2014/0119892 A1 May 1, 2014

Related U.S. Application Data

(60) Provisional application No. 61/718,349, filed on Oct. 25, 2012.

(51) Int. Cl.

| | |
|---|---|
| ***F04D 29/42*** | (2006.01) |
| ***F04D 29/44*** | (2006.01) |
| ***F04D 29/54*** | (2006.01) |
| ***F04D 17/06*** | (2006.01) |
| *F04D 29/38* | (2006.01) |

(52) U.S. Cl.

CPC ..... *F04D 17/06* (2013.01); *F04D 29/4206* (2013.01); *F04D 29/4213* (2013.01); *F04D 29/441* (2013.01); *F04D 29/444* (2013.01); *F04D 29/542* (2013.01); *F04D 29/384* (2013.01); *F04D 29/544* (2013.01); *F05D 2250/51* (2013.01)

(58) Field of Classification Search

CPC ... F04D 17/06; F04D 29/4213; F04D 29/441; F04D 29/444; F04D 29/542; F04D 29/544; F04D 29/5806; F04D 29/384

USPC ..... 417/366, 368

See application file for complete search history.

(56) References Cited

U.S. PATENT DOCUMENTS

| | | | | |
|---|---|---|---|---|
| 3,584,968 | A * | 6/1971 | Keith | F04D 17/165 415/208.2 |
| 3,719,032 | A | 3/1973 | Cash | |
| 4,089,618 | A * | 5/1978 | Patel | F04D 29/668 416/228 |
| 4,344,370 | A * | 8/1982 | Smith | F23L 17/005 110/162 |
| 4,806,076 | A | 2/1989 | Andrews | |
| 5,439,349 | A | 8/1995 | Kupferberg | |
| 5,938,527 | A * | 8/1999 | Oshima | F24F 1/01 454/303 |
| 6,112,850 | A | 9/2000 | Secrest et al. | |
| 6,431,974 | B1 | 8/2002 | Tetley et al. | |
| 6,509,081 | B1 | 1/2003 | Diamond | |
| 6,676,503 | B2 | 1/2004 | Hill et al. | |
| 7,241,214 | B2 | 7/2007 | Sixsmith | |
| 7,547,249 | B2 | 6/2009 | Seliger et al. | |

* cited by examiner

*Primary Examiner* — Peter J Bertheaud
(74) *Attorney, Agent, or Firm* — Thomas J. Germinario

(57) ABSTRACT

A mixed flow fan assembly uses induced reverse ambient air flow through the in-line motor enclosure for motor cooling, motor segregation from primary exhaust contamination, and augmentation of volumetric flow rate. Induced ambient air-flow through openings in and/or around the base of the fan housing balances low pressure around the fan wheel and the inlet cone to inhibit primary exhaust recirculation and increase volumetric flow rate. Straightening vanes downstream of the fan wheel are used to axially reorient radial and tangential velocity components of primary effluent flow. Airfoil impeller blades have a scalloped and/or perforated single-thickness trailing edge to attenuate fan noise.

3 Claims, 12 Drawing Sheets

MIXED FLOW FAN ASSEMBLY

REFERENCE TO RELATED APPLICATION

This application claims the benefit of the filing date of Provisional Application No. 61/718,349, filed Oct. 25, 2012.

BACKGROUND OF THE INVENTION

The present invention relates to the general field of inline exhaust fan assemblies, and more particularly to mixed flow fan assemblies.

In a mixed flow fan assembly, the primary exhaust gas/air flow enters the impeller axially, i.e., parallel to the impeller shaft axis, and is discharged from the impeller with both axial and radial velocity components. The objective of the present invention is to provide a mixed flow fan assembly with greater static efficiency and reduced noise output, thereby reducing the energy required to run the fan at an equivalent performance level. The fan assembly described herein is designed to operate upstream of a discharge nozzle, such as the induction nozzle described in U.S. patent application Ser. No. 13/067,269, the disclosure of which is incorporated herein by reference.

SUMMARY OF THE INVENTION

The present invention modifies the standard design of a mixed flow fan in four ways:

(1) The back plate of the fan wheel is provided with blades or contours so as to draw fresh ambient air through a multipurpose port in the fan housing, over a direct drive fan motor, and down into the fan wheel shroud through an aperture at the common centerline. This ambient air flow serves three purposes: (a) cooling the fan motor, as well as a variable frequency drive (VFD), if present; (b) maintaining positive pressure in the motor enclosure so as to segregate it from potentially contaminated primary exhaust flowing through the annular space around it; (c) diluting the primary effluent and increasing the volumetric flow rate of air/gas exiting the fan discharge, thereby increasing static efficiency.

(2) One or more openings are provided in the base of the fan housing or between the fan housing and the plenum or roof curb on which it is mounted. Fresh ambient air is induced through the opening(s) by the venturi effect of the primary exhaust exiting the fan wheel shroud. This induced air flow will enter the area surrounding the fan wheel shroud and the inlet bell and balance the low pressure generated in this region by the increased velocity of the primary exhaust exiting the fan wheel shroud. Otherwise, this low pressure region will draw some of the primary exhaust from the impeller outlet back down below the impeller inlet, causing recirculation of a portion of the primary exhaust airstream and consequent loss of efficiency. By minimizing primary exhaust recirculation and adding induced ambient air, the volumetric flow rate is increased to produce greater static efficiency.

(3) Impeller blades are designed with airfoil profiles, with an overlap of substrate at the trailing edge creating a single-thickness trailing edge, which can be shaped and/or perforated to reduce operational fan noise.

(4) In order to axially redirect the radial and tangential velocity vectors of the primary exhaust leaving the fan wheel shroud, full length straightening vanes are provided in the annular space within the fan housing. Each straightening vane transitions from a curved leading edge to a substantially axial trailing edge, thereby transitioning the primary airflow to an axial flow as it exits the fan housing. This reorientation of the primary airflow velocity results in a greater volumetric flow rate and increased overall static efficiency of the fan assembly.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
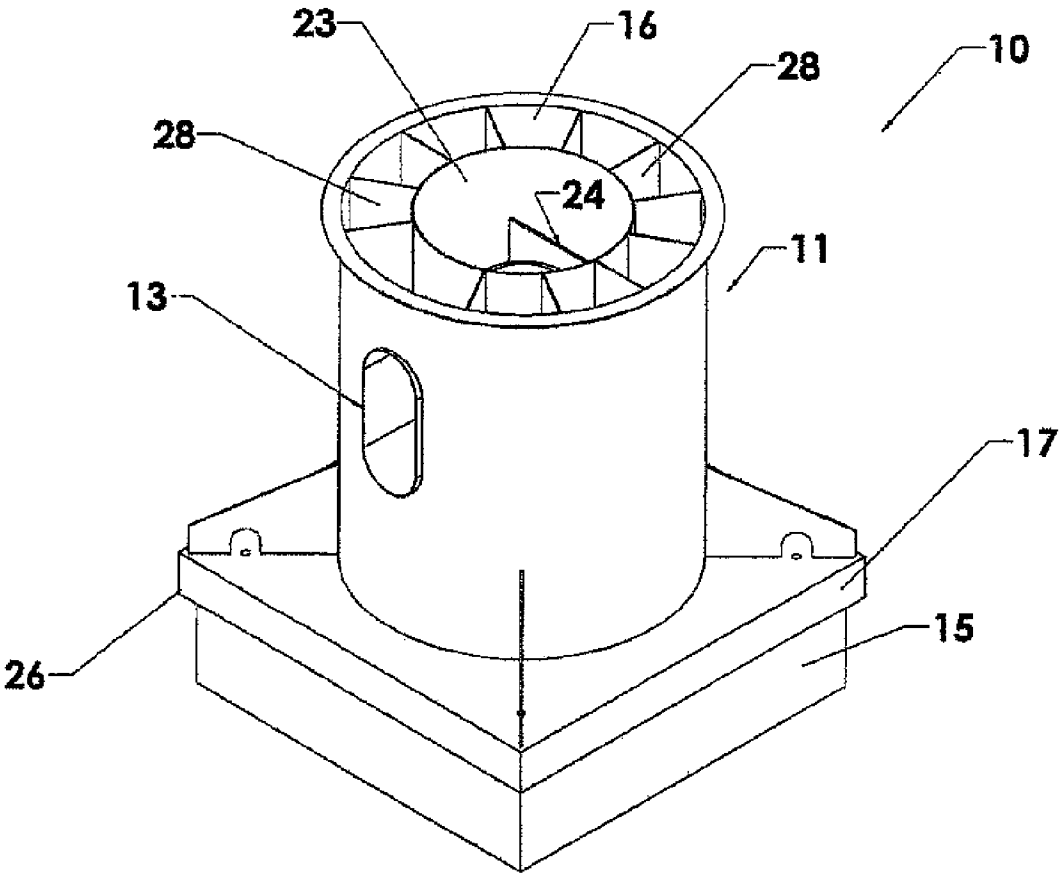
FIG. 1 is a top perspective view of a mixed flow fan assembly according to the preferred embodiment of the present invention.
Figure 2:
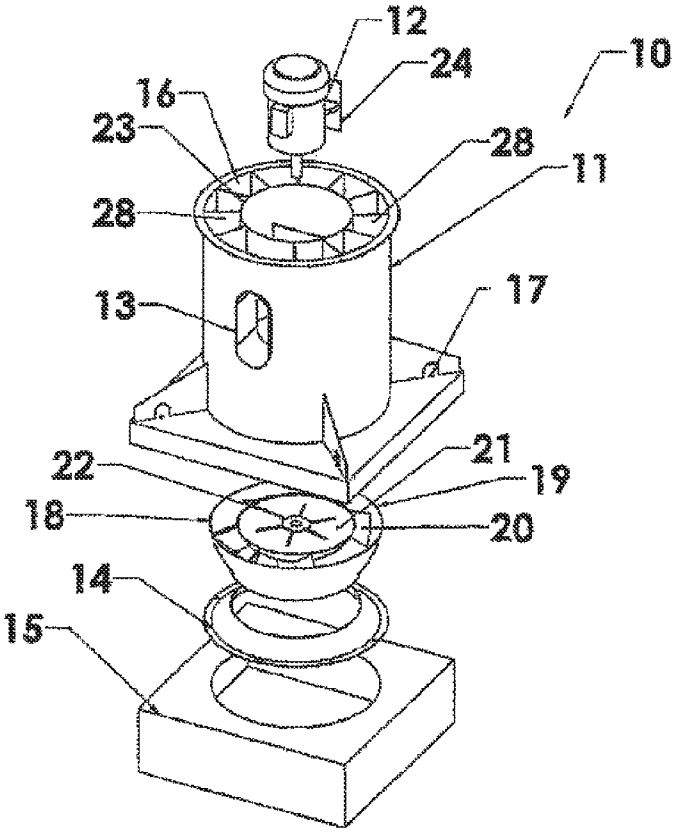
FIG. 2 is a top exploded view of a mixed flow fan assembly according to the preferred embodiment of the present invention.
Figure 3:
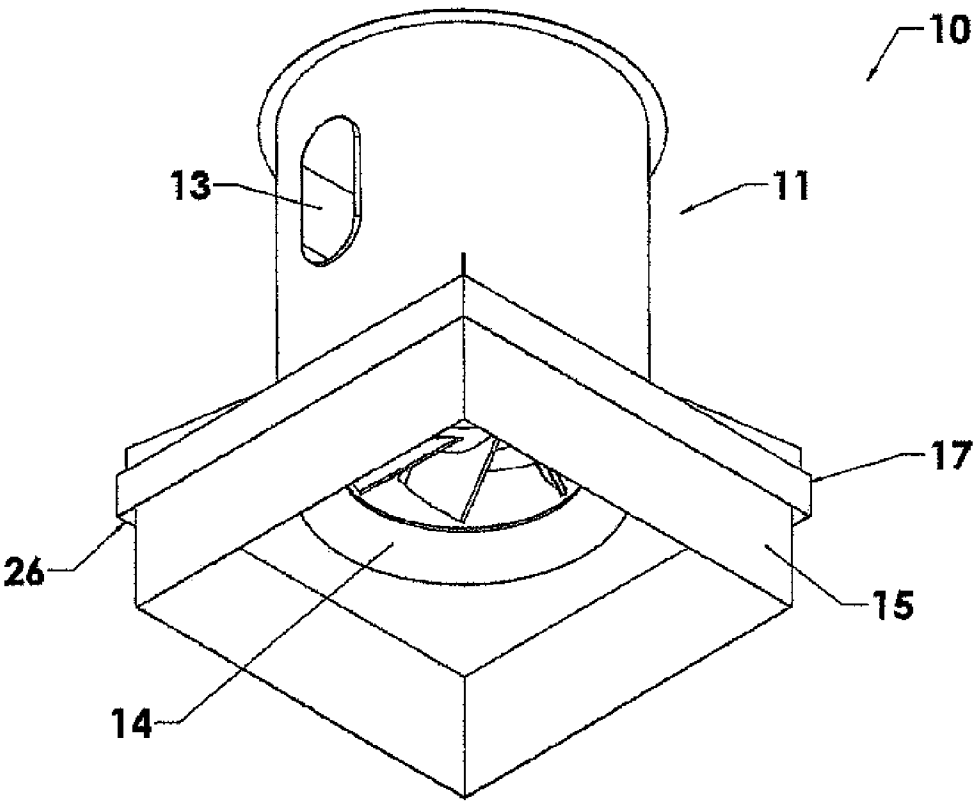
FIG. 3 is a bottom perspective view of a mixed flow fan assembly according to the preferred embodiment of the present invention.
Figure 4:
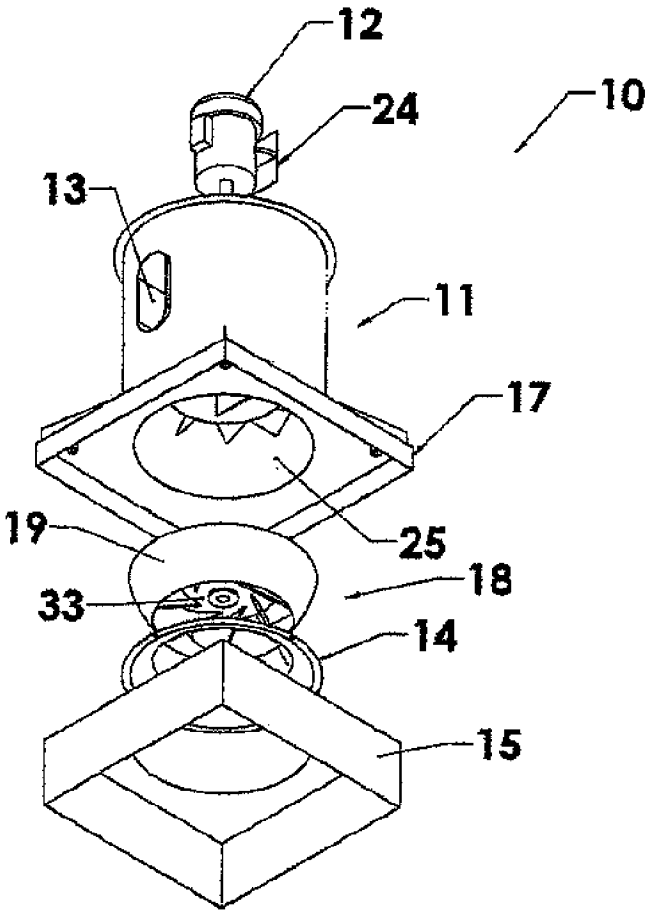
FIG. 4 is a bottom exploded view of a mixed flow fan assembly according to the preferred embodiment of the present invention.

Referring to FIGS. 1-5B, an embodiment of a mixed flow fan assembly according to the present invention 10 comprises a cylindrical fan housing 11, the base 17 of which is supported on a mounting plenum 15. The perimeter of the fan housing base 17 is oversized with respect to that of the mounting plenum, so as to leave a peripheral base opening 26, through which ambient air can enter the fan housing 11.

The upper portion of the fan housing 11 is internally divided into an axially central cylindrical motor enclosure 23 surrounded by an annular cylindrical exhaust plenum 16. The motor enclosure 23 contains an in-line fan motor 12, which is mounted on a vertical mounting plate 24, thereby enabling the bottom of the motor enclosure 25 to remain open. A multi-purpose port 13 accesses the interior of the motor enclosure 23 through the exterior of the fan housing 11 and the exhaust plenum 16.

In the lower portion of the fan housing 11 below the motor enclosure 23 is the fan wheel 18, which comprises a shroud 19, a back plate 21, and a wheel cone 33. Multiple impeller blades 20 are attached to both the wheel cone 33 and the shroud 19. The shroud 19 has an inverted bell shape comprising a sphero-conical section, which opens at its lower end into a substantially frusto-conical inlet bell 14. The upper opening of the inlet bell 14 has a slightly smaller circumference than that of the lower opening of the shroud 19, so that the fan wheel 18 can rotate without interference. The lower end of the inlet bell 14 opens into the mounting plenum 15, through which the primary exhaust gas/air flows upward into the fan housing 11.

In operation, the fan motor 12 imparts rotation to the fan wheel 18 via a motor-impeller shaft coupling 27. The rotating impeller blades 20 draw the primary exhaust flow upward through the inlet bell 14 and the fan wheel shroud 19, from which the exhaust flow is accelerated upward into the annular exhaust plenum 16 and discharges through the top of the fan housing 11.

Referring to FIGS. 5A-7, the back plate 21 of the fan wheel 18 has a series of radial blades 22, which rotate along with the fan wheel 18. The rotation of the radial blades 22 draws ambient air through the multi-purpose port 13 into the interior of the motor enclosure 23 and downward into the fan wheel shroud 19 through the open bottom 25 of the motor enclosure 23. In addition to cooling the motor 12, this reverse air flow maintains a positive pressure in the motor enclosure 23 so as to isolate the motor 12 from the potentially contaminated primary exhaust flow through the annular exhaust plenum 16. When this reverse air flow reaches the impeller blades 20, it merges with the primary exhaust, thereby increasing the volumetric exhaust flow rate and enhancing static efficiency, as well as diluting the primary exhaust.

Figure 5A:
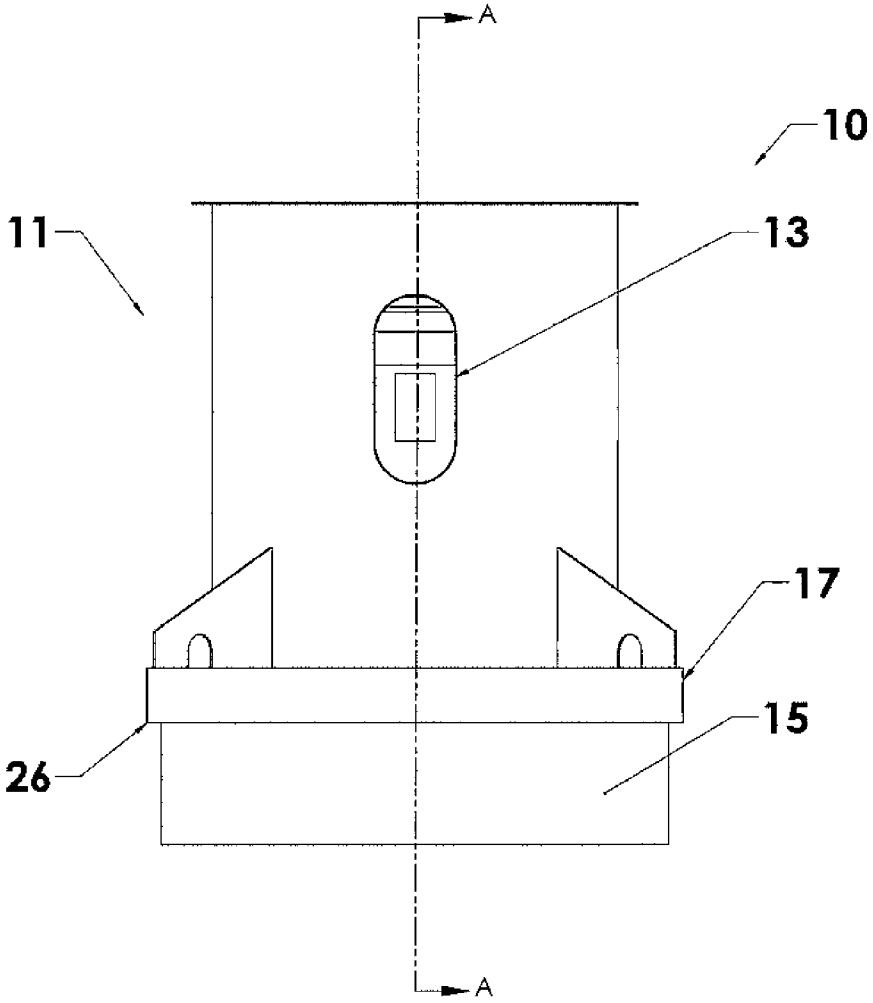
FIG. 5A is a side profile view of a mixed flow fan assembly according to the preferred embodiment of the present invention.
Figure 5B:
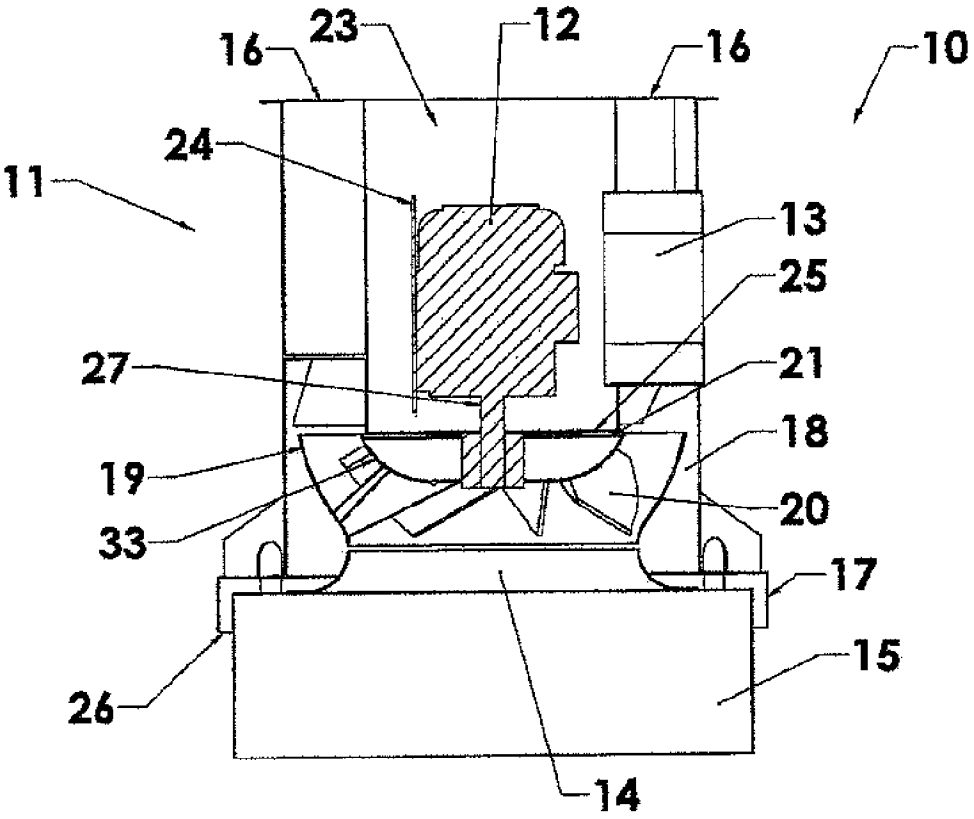
FIG. 5B is an axial cross-section view, along the line A-A in FIG. 5A, of a mixed flow fan assembly according to the preferred embodiment of the present invention.
Figure 6:
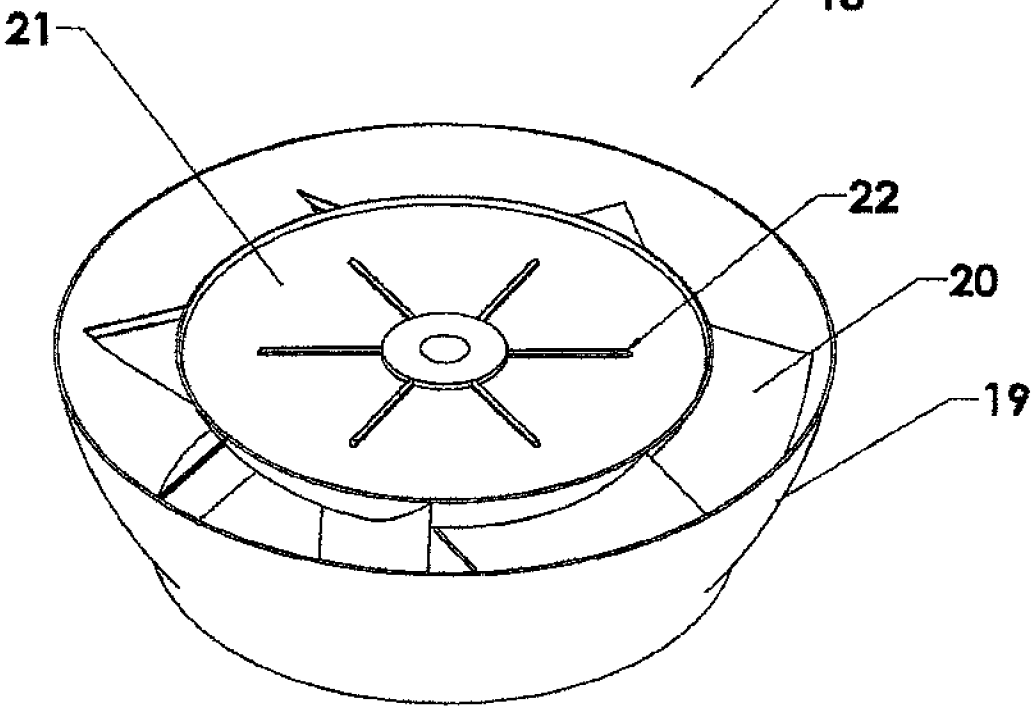
FIG. 6 is a top perspective detail view of a fan wheel with radial blades on the back plate according to the preferred embodiment of the present invention.
Figure 7:
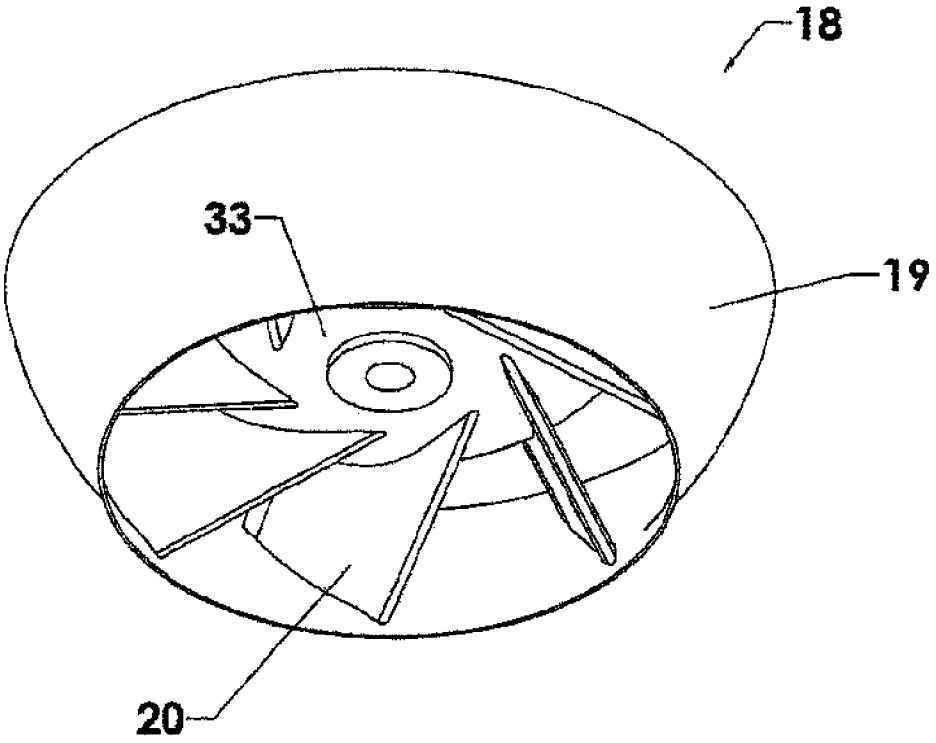
FIG. 7 is a bottom perspective detail view of a fan wheel according to the preferred embodiment of the present invention.

One of the problems with mixed flow fans is that the venturi effect of the exhaust flow exiting from the wheel shroud 19 up into the annular exhaust plenum 16 creates a low pressure region in the lower portion of the fan housing 11 around the exteriors of the wheel shroud 19 and the inlet bell 14 (as best seen in FIG. 5B). If not balanced with a positive pressure, this low pressure region tends to draw some of the primary exhaust downward from the exhaust plenum 16 back into the lower opening of the fan wheel shroud 19. Such recirculation of primary exhaust flow causes a loss in efficiency.

The present invention 10 addresses this problem by creating openings in and/or around the base 17 of the fan housing 11. In the embodiment illustrated in FIG. 5, the gap 26 between the oversized fan housing base 17 and the mounting plenum 15 operates as an induction port, through which the venturi effect of the primary exhaust exiting the fan wheel shroud 19 draws ambient air into the low pressure region surrounding the fan wheel shroud 19 and the inlet bell 14. The positive pressure of this induced air flow balances the low pressure in this region and thereby inhibits the recirculation of primary exhaust gases. The induced air flow also has the effect of augmenting the exhaust volumetric flow rate, thus achieving better static efficiency.

Figure 11:
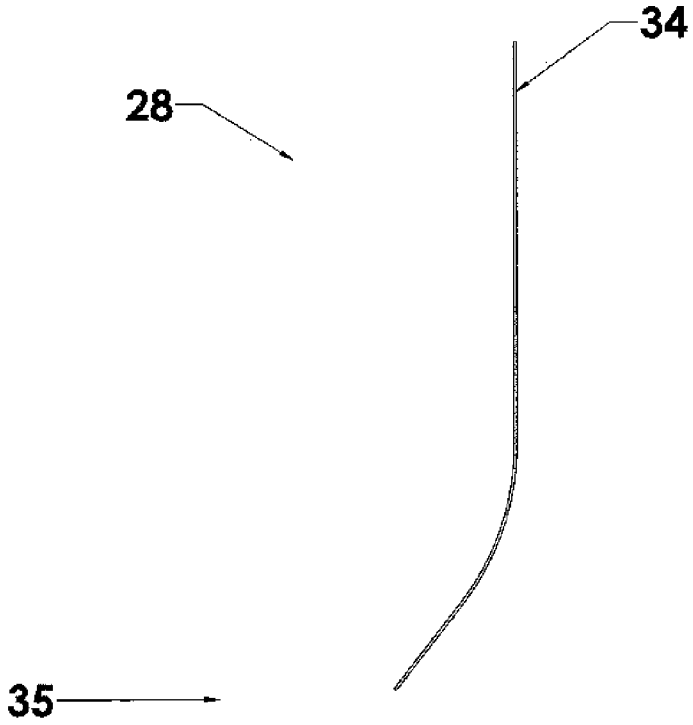
FIG. 11 is a detail view of the vertical profile of a straightening vane according to the preferred embodiment of the present invention

Another problem associated with mixed flow fan designs is the loss of efficiency due to radial and tangential velocity components of the primary exhaust flow exiting the fan wheel shroud 19. The present invention addresses this problem by providing multiple straightening vanes 28, which extend radially from the perimeter of the motor enclosure 23 through the annular exhaust plenum 16 to the fan housing 11. As shown in FIG. 11, the straightening vanes 28 have a vertical profile which transitions from a curved leading edge 35 to a substantially axial trailing edge 34. This profile of the straightening vanes 28 has the effect of diverting the primary effluent flow in the axial direction, which results in a greater volumetric flow rate and increased overall static efficiency of the fan assembly.

Figure 8:
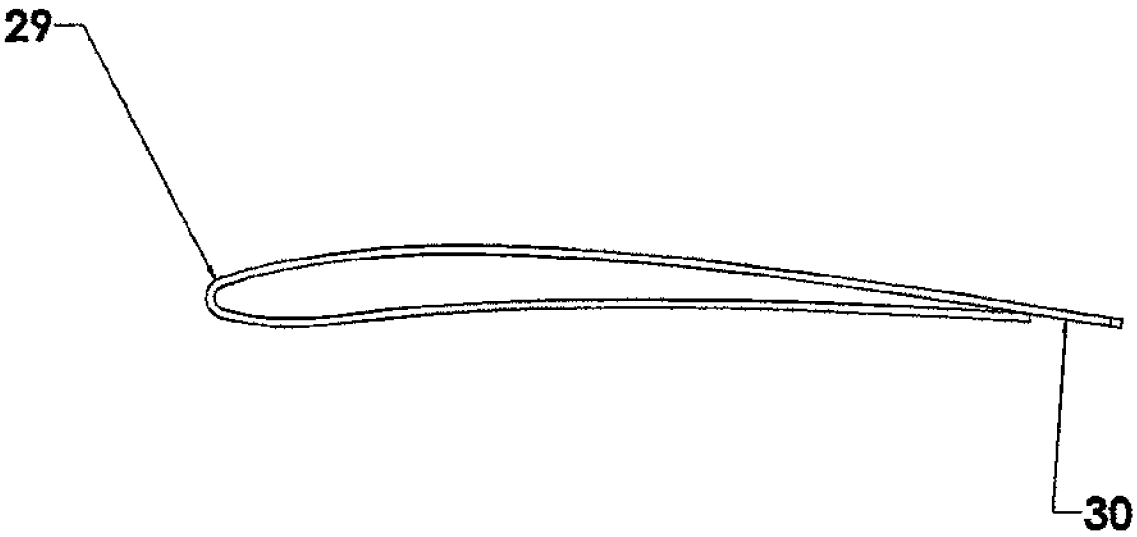
FIG. 8 is a side profile detail view of an airfoil impeller blade according to the preferred embodiment of the present invention.
Figure 9:
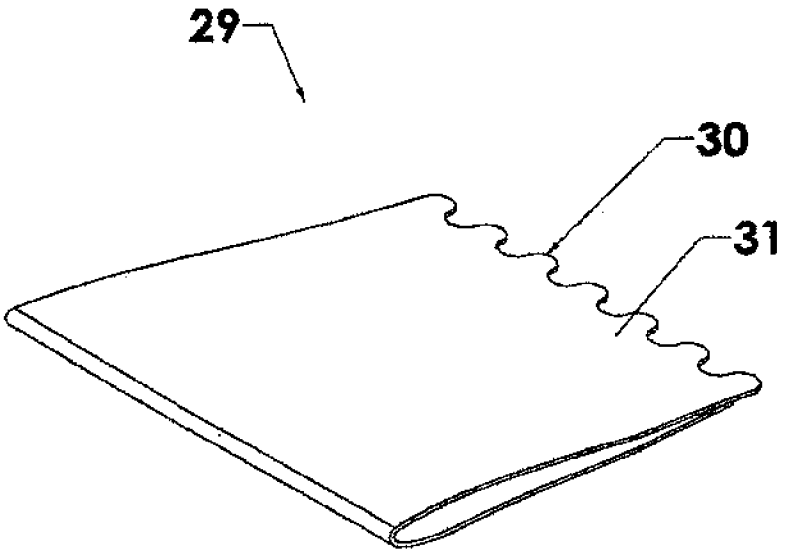
FIG. 9 is a perspective detail view of an airfoil impeller blade with a scalloped trailing edge according to the preferred embodiment of the present invention.
Figure 10:
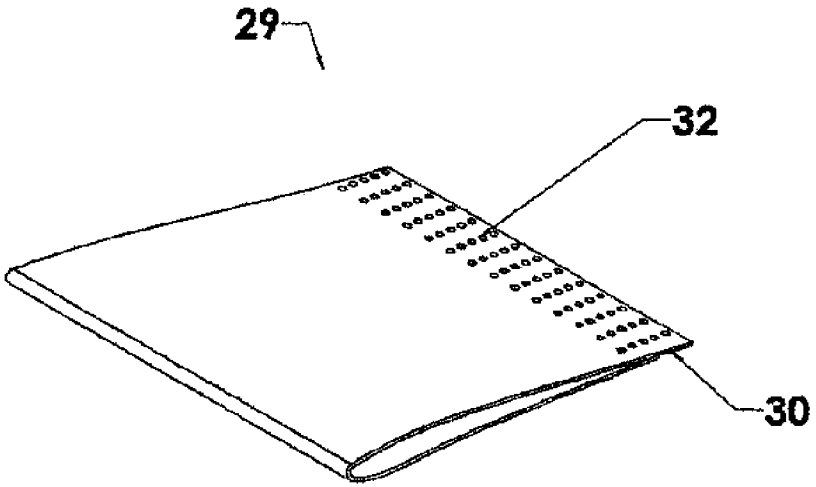
FIG. 10 is a perspective detail view of an airfoil impeller blade with a perforated trailing edge according to the preferred embodiment of the present invention.

Referring now to FIGS. 8-10, the impeller blades 20 of this embodiment of the present invention 10 have an airfoil profile 29, with an overlap of substrate forming a single-thickness trailing edge 30. This trailing edge can be scalloped 31 and/or perforated 32, so as to attenuate operational fan noise.

Although the preferred embodiments of the present invention have been disclosed for illustrative purposes, those skilled in the art will appreciate that many additions, modifications and substitutions are possible, without departing from the scope and spirit of the present invention.

What is claimed is:

1. A mixed flow fan assembly, comprising:

a fan housing, having a top and a base that is supported on a mounting plenum, and having an upper portion that is internally divided into an axially central motor enclosure surrounded by an exhaust plenum, and having a lower portion that contains a fan wheel and an inlet bell;

the fan wheel, comprising a back plate, a shroud, a wheel cone, and multiple impeller blades attached to both the wheel cone and the shroud, wherein the shroud has an inverted bell shape and has a lower end which opens into the inlet bell, and wherein the inlet bell has a substantially frusto-conical shape and has a lower end which opens into the mounting plenum, through which a primary exhaust gas flow flows upward into the fan housing;

a fan motor located in the motor enclosure and rotatably coupled to the fan wheel through a motor-impeller shaft coupler, such that the fan motor imparts rotation to the fan wheel and the impeller blades, and such that the rotation of the impeller blades draw the primary exhaust gas flow upward through the inlet bell and the shroud and accelerates the primary exhaust gas flow upward into the exhaust plenum, from which the primary exhaust gas flow is discharged through the top of the fan housing;

wherein the motor enclosure has a bottom that opens into the lower portion of the fan housing, and wherein a multi-purpose port accesses the motor enclosure from outside the fan housing through the exhaust plenum;

wherein the back plate of the fan wheel has multiple back plate blades, such that rotation of the back plate blades draws a first ambient air flow through the multi-purpose port into the motor enclosure and down into the fan wheel;

wherein the first ambient air flow cools the fan motor, and wherein the first ambient air flow maintains a positive pressure in the motor enclosure so as to pneumatically segregate the fan motor from the primary exhaust gas flow through the exhaust plenum, and wherein the flow of the first ambient air flow into the fan wheel dilutes the primary exhaust gas flow and produces a combined air/gas exhaust flow, which is expelled from the shroud with an increased volumetric flow rate, thereby increasing the static efficiency of the mixed flow fan assembly;

wherein multiple straightening vanes are radially disposed within the exhaust plenum, and wherein the straightening vanes have a vertical profile which transitions from a lower curved leading edge to an upper substantially axial trailing edge, and wherein the straightening vanes divert the air/gas exhaust flow in the axial direction, and increase the volumetric flow of the air/gas exhaust flow, thereby increasing the static efficiency of the mixed flow fan assembly; and wherein one or more inlet openings are located between the base of the fan housing and the mounting plenum, and wherein a second ambient air flow is induced through the inlet openings by a venturi effect of the air/gas exhaust flow expelled from the shroud of the fan wheel, and wherein the aforesaid venturi effect draws the second ambient air flow through the lower portion of the fan housing and into an area of a low pressure generated by the air/gas exhaust flow expelled from the shroud and surrounding the shroud and the inlet bell, and wherein the second ambient air flow around the shroud and the inlet bell offsets the low pressure generated by the air/gas exhaust flow expelled from the shroud, thereby reducing an efficiency loss caused by a recirculation of the air/gas exhaust flow within the fan wheel, and thereby increasing volumetric flow rate through the fan wheel.

2. The mixed flow fan assembly according to claim 1, wherein the impeller blades have air foil profiles with a single-thickness trailing edge.

3. The mixed flow fan assembly according to claim 2, wherein the trailing edge of the impeller blades is scalloped or perforated, so as to attenuate fan noise.

* * * * *